US005984603A

United States Patent [19]

Boetschi et al.

[11] Patent Number: 5,984,603

[45] Date of Patent: Nov. 16, 1999

[54] APPARATUS FOR PRODUCING BOOK BLOCKS FROM A STACK OF SIGNATURES

[75] Inventors: Heinz Boetschi, Mauren; Hans Hollenstein, Guntershausen, both of Switzerland

[73] Assignee: Grapha-Holding AG, Switzerland

[21] Appl. No.: 09/075,260

[22] Filed: May 11, 1998

Related U.S. Application Data

[60] Continuation-in-part of application No. 08/577,190, Dec. 22, 1995, abandoned, which is a division of application No. 08/162,474, Dec. 7, 1993, Pat. No. 5,507,524.

[51] Int. Cl.[6] ..... B42B 2/00

[52] U.S. Cl. ..... 412/35; 412/9

[58] Field of Search ..... 281/27; 412/9, 412/11, 16, 18, 29, 35, 36; 112/21, 22

[56] References Cited

U.S. PATENT DOCUMENTS 4,704,973 11/1987 Horst ..... 412/35 X
5,248,234 9/1993 Hollenstein ..... 412/1
5,507,524 4/1996 Botschi et al. ..... 412/35 X
5,887,532 3/1999 Hollenstein et al. ..... 412/35 X

*Primary Examiner*—Willmon Fridie, Jr.
*Attorney, Agent, or Firm*—Venable; George H. Spencer; Robert Kinberg

[57] ABSTRACT

An apparatus for producing book blocks from a stack of aligned signatures each having a fold and which together form a spine of a book block. An arrangement for stitching stitches the signatures together with at least two spaced transverse seams formed of a double strand of binding thread passing through each of the folds of the signatures from a location outside of the signatures and extending along an inner edge of each of the folds to an exit point in each of the folds. The transverse seams include a chained transverse seam having loop-like binding thread sections. An interrupting arrangement interrupts the chained transverse seam at an end region of the book block such that a last formed loop-like section of the binding thread remains unchained and is left at the end region of the book block. An unreleasably fastening arrangement unreleasably fastens the last formed loop-like section to either the chained transverse seam and the folds of the signatures.

10 Claims, 3 Drawing Sheets

APPARATUS FOR PRODUCING BOOK BLOCKS FROM A STACK OF SIGNATURES

CROSS REFERENCE TO RELATED APPLICATION

This application claims the priority of application Ser. No. CH 03,770/92-8, filed Dec. 9th, 1992, in Switzerland, the subject matter of which is incorporated herein by reference.

This application is a continuation-in-part application of Ser. No. 08/577,190, filed Dec. 22, 1995, now abandoned, incorporated herein by reference, which was a divisional of application Ser. No. 08/162,474, filed Dec. 7, 1993, now U.S. Pat. No. 5,507,524.

BACKGROUND OF THE INVENTION

The present invention relates to an apparatus for producing book blocks from a stack of signatures that are aligned with one another on their flat sides and are stitched together by means of a binding thread, with their folds forming the spine of the book block. The book block has at least two spaced transverse seams formed of a double strand of binding thread that passes through the folds of the signatures from the outside and extends along the inner edge of the fold to their 15 exit points. One of the two transverse seams is formed of a chain of loop-like binding thread sections that are successively pulled out of the folds of the signatures, with the chain being interrupted after a stack section has been formed that determines the book block.

EP-A-0,295,220 discloses an apparatus of the above formulated type according to which book blocks are separated from a stack of signatures by cutting through the binding thread at the so-called flat seam under the influence of a tensioning force generated by the moving stack of signatures. These threads are pulled out of the fold of the signatures at the adjacent loop seam or chained seam, respectively, and then cut apart by a knife. This manner of proceeding produces a breather or relaxation, respectively, between the signatures which has a negative influence on the stability of the book blocks and the compactness to be produced by the stitching.

By changing the binding thread from the hook needle to the knife, an additional unreliability moment is created with respect to the transfer.

SUMMARY OF THE INVENTION

It is therefore an object of the present invention to create an apparatus of the above-mentioned type with which the production of book blocks that are stitched with a binding thread can be made more reliable and the device employed can be made simpler.

This is accomplished according to the present invention in that the loop-like section of the binding thread formed for a book block is permanently fastened or anchored, respectively, to the spine of a book block formed by the folds of the signatures or to the chained transverse seam by a means for unreleasably fastening. Thus it becomes possible to further process the book blocks without damage after the stitching.

In this way, it is possible to avoid, for example, an additional empty stitch or a glue connection with the last signature of a book block.

Advantageously, the last loop-like section of the binding thread can be shrunk by means of heat into a formlocking anchorage or can be shrink-connected with the existing transverse seam so that it is impossible for the signature to breathe or the binding seam to be partially loosened.

An alternative type of fastening or anchorage resides in the last loop-like section of the binding thread being fastened to the spine of the book block by supplying a flowable and hardening substance, such as glue, or by welding.

Advisably, the last loop-like section of the binding thread can be cast to the spine of the book block by supplying a castable substance.

In an embodiment that has been found to be favorable, the binding thread is anchored in a form locking manner to the spine of the book block by deformation of its last looplike section.

The means or arrangement for unreleasably fastening may hence include any conventional arrangement for applying heat to the last loop-like section for shrinking the same, any conventional arrangement for supplying a flowable and hardable substance to the last loop-like section or for welding the last loop-like section, or any conventional means for deforming the last loop-like section.

A suitable device for implementing the invention further includes, among others, drives for the supplied signatures and the advance of the thus formed stack and for at least two needles (needle pairs) that process the binding thread by stitching. The needle associated with the chained transverse seam is configured as a hook needle which, in the position in which it enters into the signature through the fold, receives the binding thread, by way of a thread carrier that oscillates within the signature, from another needle which penetrates the fold and guides the binding thread. Another drive is provided for a severing device for cutting off the binding thread in that the hook needle has an associated control device for preventing a rotary movement, thus forming an exposed loop-like section of the binding thread at the end of the book block.

BRIEF DESCRIPTION OF THE DRAWING

The invention will now be described with reference to embodiments thereof illustrated in the drawings.

DETAILED DESCRIPTION OF THE PREFERRED EMBODIMENT

The illustrated stack 1 is subjected to a sewing process in the direction of arrow A and the signatures 2 required for this purpose are each supplied from the bottom to the rear of the moving stack 1. Stack 1 may be advanced by any conventional means for advancing 20 (that is, any conventional advancing arrangement). According to the illustration, a stitched book block of three signatures 2 is present as well as a book block which is directly before completion of the stitching process.

Figure 1:
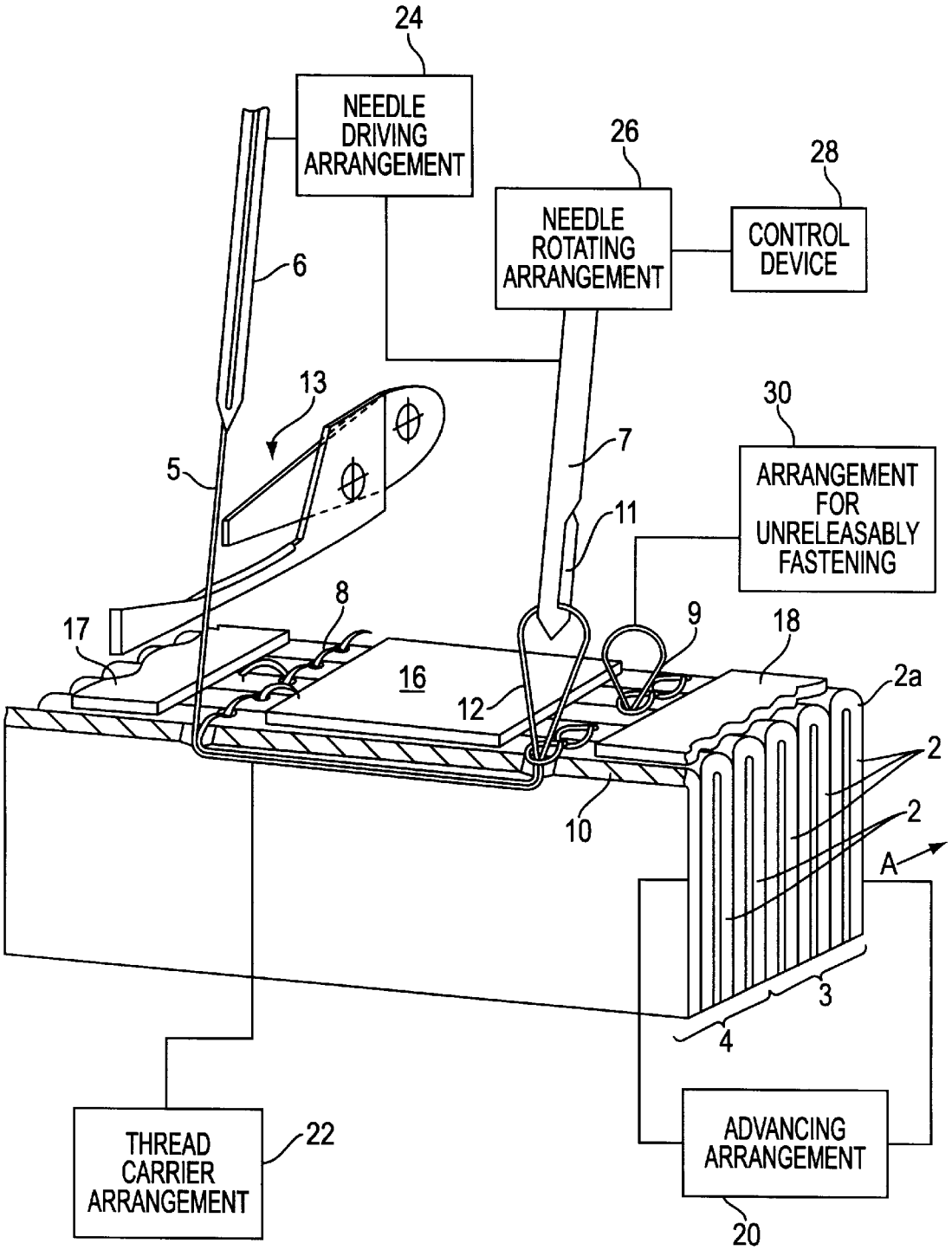
FIG. 1 depicts a stack of signatures composed of two stitched together book blocks where the last formed loop-like section of the chained transverse seam is shown.

According to the portion of the fabrication process shown in FIG. 1, a first signature 2*a* intended for the subsequent book block 4 has been placed against the stitched book block 3. This signature was initially prepared from the bottom by a means for stitching comprising piercing needles which pass through the fold from the inside out to enable the binding thread 5 in a needle 6 disposed there above to be pulled through. With the return movement (not shown) of the piercing needles, needle 6 supplying the binding thread 5, and hook needle 7, which together form a pair of needles for producing two transverse seams 8 and 9, are pushed through the pierced openings in the fold 10 of the signature 2 being processed. A loop is formed of the double-stranded binding thread 5 which is pushed to below the inner edge of the fold, for example by briefly retracting needle 6, so that a so-called thread gripper, such as any conventional thread carrier arrangement 22 is able to grip binding thread 5 at the resulting loop and transport it to the opposite side associated with transverse seam 9. Here, binding thread 5 is expected by the immersed hook needle 7 and taken over at a hook 11 by a tipping movement of the thread gripper. Thereafter, needles 6 and 7 return to their starting positions above the just processed signature 2 and the thread gripper is returned to its starting positions. This causes a loop or a loop-like section 12 to be formed of binding thread 5 at the hook needle 7 above signature 2. This loop is partially tensioned by a resetting force and extends along the inner edge of the fold. The needles may be driven by any conventional need driving means or arrangement 24.

Then the hook needle 7 is rotated about 180° so that hook 11 is oriented in a direction opposite to the direction of advance of stack 1. This rotation of hook needle 7 serves to chain the loop-like section 12 so that the latter is unable to lip from hook needle 7, but instead loops around the latter when it is lowered for the next signature 2, with the tensioning force acting on binding thread 5 reducing the size of loop-like section 12 corresponding to the distance from the next signature 2. On its way into its position within the next signature 2, hook needle 7 turns back into the position in which hook 11 is oriented in the direction of advance A of stack 1. Needle 7 may be rotated by any conventional needle rotating means or arrangement 26.

For the present case, where four signatures 2 form a book block 3 or 4, respectively, this process is repeated twice after the first signature and is changed for the fourth, that is, the last signature 2 for a book block in that hook needle 7 is prevented from rotating after the formation of loop-like section 12 so that the latter, when hook needle 7 is lowered for the first signature of the next book block, is released from hook 11 and from hook needle 7, thereby causing an interruption of the chained transverse seam and resulting in a last formed loop-like section 21 as shown in FIG. 1. The needle 7 is rotated and prevented from rotating by a suitable needle rotating arrangement 26 that may comprise, for example, a pinion (not shown) coaxially connected to needle 7 and rotatingly driven by a toothed rack (not shown) that is linearly driven by a control device 28 that comprises a suitable mechanical linkage as would be understood by those skilled in the art.

Upon forming the last loop-like section, the thread tension is initially released and, in the present case, the cutting device 13 is used and moved to the side in such a way that the binding thread 5, during the mentioned lifting movement of needle 6, places itself around a cutting blade 14 at cutting device 13. For the cutting process to be performed without malfunction, it is recommended to employ a scissors-like cutting device 13 with which it is possible to avoid further pulling on the retensioned binding thread 5 at the loop-like section.

In the further course of the stitching operation, namely when it is positioned between two scissor blades by the signatures 2 or book blocks 3 and 4 that continue to be displaced in the direction of arrow A, the binding thread 5 lying above the lower scissors blade is cut. Until this moment, the binding thread is displaced above the scissors blade together with its associated signature 2.

As an aid, the region of binding thread 5 to be cut could be clamped in at the closest needle plate 16, 17, 18 so as to avoid stresses. The latter serves as a hold-down member for signatures 2 and as a protection against binding thread 5 tearing out of signatures 2 during the stitching process.

A suitable means or arrangement 30 is provided for unreleasable fastening or anchoring the last loop-like section to the spine of the book block. Arrangement 30 may include any conventional arrangement for applying heat to the last loop-like section for shrinking the same, any conventional arrangement for supplying a flowable and hardenable substance to the last loop-like section or for welding the last loop-like section, or any conventional means for deforming the last loop-like section.

Figure 2:
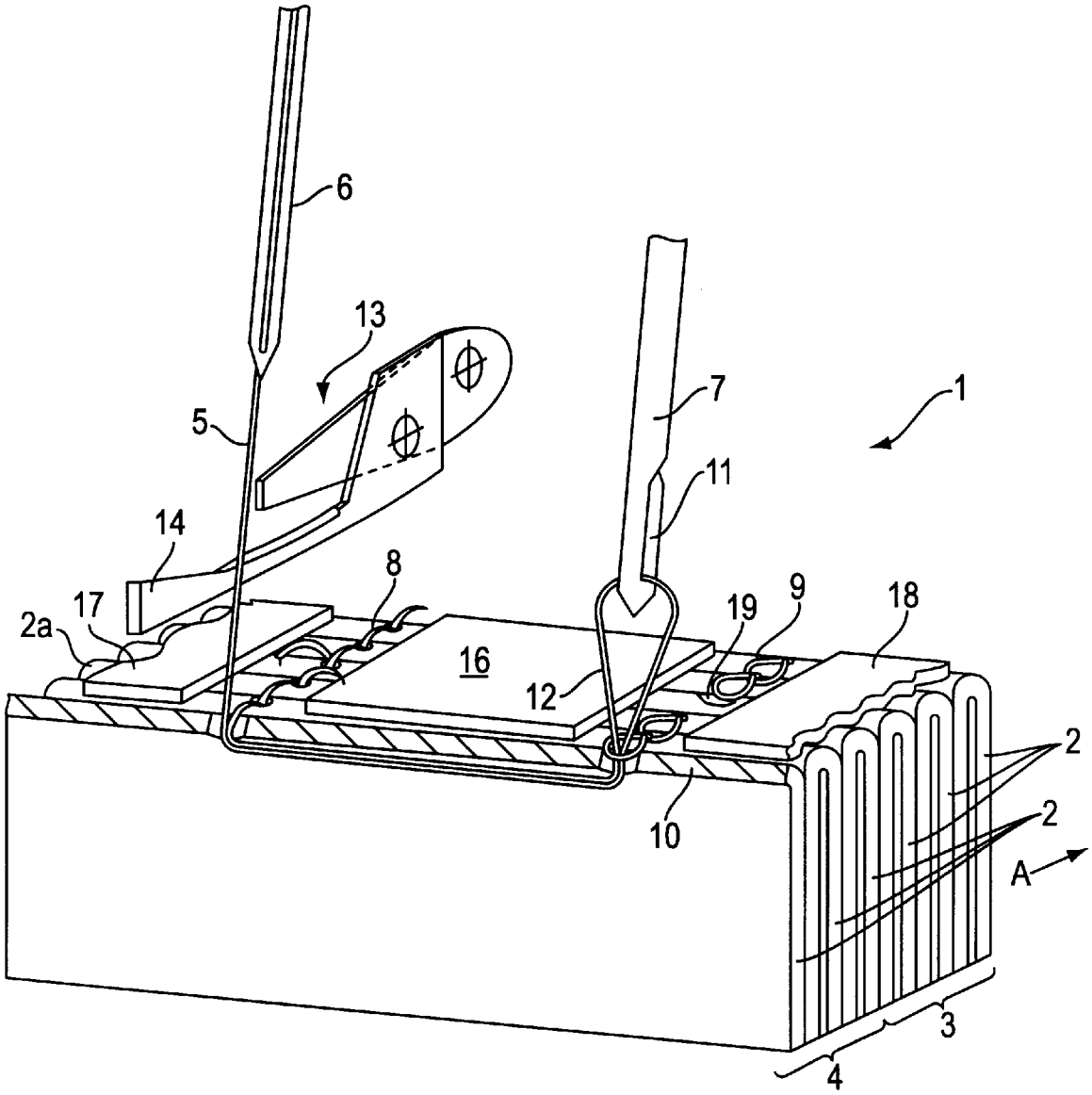
FIG. 2 is a view similar to that of FIG. 1, where the last formed loop-like section is shown as being fastened in place by either being shrunk or glued.

FIG. 2 shows the last loop-like section 21 of the binding thread as being shrunk by means of heat into a form-locking anchorage, or shrink-connected with the existing transverse seam at location 19. Location 19 can be viewed as alternately showing the last loop-like section as being fastened by glue to the spine of the book block.

Figure 3:
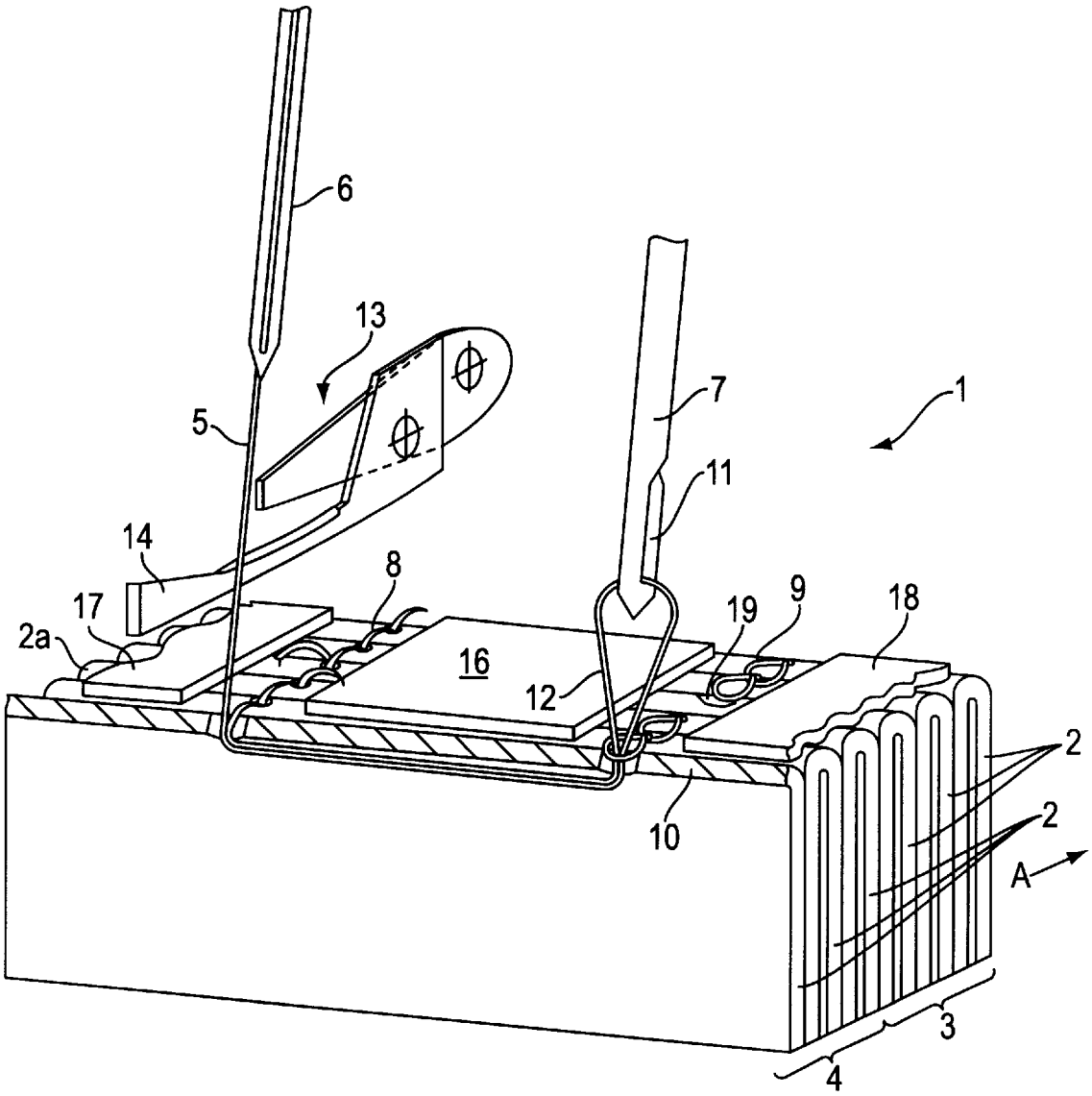
FIG. 3 is a view similar to that of FIG. 1, where the last formed loop-like section is shown as being deformed to be form lockingly anchored to the chained transverse seam.

FIG. 3 shows the last formed loop-like section 21 of the binding thread as being deformed to be formed lockingly anchored to the chained transverse seam at location 19.

It will be understood that the above description of the present invention is susceptible to various modifications, changes and adaptations, and the same are intended to be comprehended within the meaning and range of equivalents of the appended claims.

What is claimed is:

1. An apparatus for producing book blocks from a stack of aligned signatures each having a fold and which together form a spine of a book block, comprising:

means for stitching the signatures together with at least two spaced transverse seams formed of a double strand of binding thread passing through each of the folds of the signatures from a location outside of the signatures and extending along an inner edge of each of the folds to an exit point in each of the folds, the transverse seams including a chained transverse seam having loop-like binding thread sections;

means for interrupting the chained transverse seam at an end region of the book block such that a last formed loop-like section of the binding thread remains unchained and is left at the end region of the book block; and means for unreleasably fastening the last formed loop-like section to at least one of the chained transverse seam and the folds of the signatures.

2. The apparatus according to claim 1, wherein the means for stitching includes:

at least two needles comprising:

a first needle effective for successively penetrating into the folds for guiding the binding thread into the folds for forming a first one of the transverse seams as a flat transverse seam; and a second needle configured as a hook needle and effective for chaining together the loop-like binding thread sections by successively penetrating into the folds, hooking onto the binding thread present in the folds and pulling the loop-like binding thread sections out of the folds for forming a second one of the transverse seams as the chained transverse seam; and a thread carrier oscillating between the first needle and the second needle for transferring the binding thread guided into the folds by the first needle to the second needle penetrating into the folds.

3. The apparatus according to claim 2, wherein:

the means for stitching further includes means for rotating the second needle after the second needle pulls each of the loop-like binding thread sections successively out of the folds for chaining the loop-like binding thread sections to prevent unhooking the loop-like binding thread sections from the second needle; and the means for interrupting includes a control device operatively connected to the means for rotating for preventing a rotation of the second needle at the end region of the book block such that a last formed loop-like section of the binding thread remains unchained and is left at the end region of the book block.

4. The apparatus according to claim 2, further including a cutting device for cutting the binding thread for interrupting the flat transverse seam at the end region of the book block.

5. The apparatus according to claim 4, wherein the cutting device comprises scissors driven to move transversely with respect to a direction of advance of the stack of signatures.

6. The apparatus according to claim 2, further including:

means for advancing the stack of signatures; and means for driving the needles.

7. The apparatus according to claim 1, wherein the means for unreleasably fastening is adapted to heat and thereby shrink the last formed loop-like section.

8. The apparatus according to claim 1, wherein the means for unreleasably fastening is adapted to supply a flowable and hardening substance to the last formed loop-like section.

9. The apparatus according to claim 1, wherein the means for unreleasably fastening is adapted to weld the last formed loop-like section.

10. The apparatus according to claim 1, wherein the means for unreleasably fastening is adapted to deform the last formed loop-like section, for unreleasably fastening the last formed loop-like section to the chained transverse seam.

* * * * *